US008931642B2

(12) United States Patent
Simmons

(10) Patent No.: US 8,931,642 B2
(45) Date of Patent: Jan. 13, 2015

(54) ACTIVATED FLOTATION CIRCUIT FOR PROCESSING COMBINED OXIDE AND SULFIDE ORES

(71) Applicant: William D. Simmons, Holladay, UT (US)

(72) Inventor: William D. Simmons, Holladay, UT (US)

( * ) Notice: Subject to any disclaimer, the term of this patent is extended or adjusted under 35 U.S.C. 154(b) by 0 days.

(21) Appl. No.: 14/153,931

(22) Filed: Jan. 13, 2014

(65) Prior Publication Data

US 2014/0197076 A1 Jul. 17, 2014

Related U.S. Application Data

(60) Provisional application No. 61/848,844, filed on Jan. 14, 2013.

(51) Int. Cl.

| | |
|---|---|
| ***B03D 1/02*** | (2006.01) |
| ***B03D 1/002*** | (2006.01) |
| ***B03D 1/06*** | (2006.01) |
| ***C22B 3/22*** | (2006.01) |

(52) U.S. Cl.
CPC *B03D 1/06* (2013.01); *B03D 1/002* (2013.01); *B03D 1/02* (2013.01)
USPC ..... 209/166; 209/167; 75/727; 423/22; 423/26; 423/27

(58) Field of Classification Search
USPC ..... 209/166, 167; 423/22, 26, 27; 75/727
See application file for complete search history.

(56) References Cited

U.S. PATENT DOCUMENTS

| | | | | |
|---|---|---|---|---|
| 496,951 | A | 5/1893 | Parkes | |
| 1,288,121 | A * | 12/1918 | Morse | 75/727 |
| 1,627,582 | A | 5/1927 | Terry | |
| 3,317,313 | A | 5/1967 | Biigs | |

(Continued)

FOREIGN PATENT DOCUMENTS

| | | |
|---|---|---|
| CA | 2 664 756 | 11/2002 |
| GB | 2310424 A * | 8/1997 |

OTHER PUBLICATIONS

Arima, Harunobu; Fujita, Toyohisa; and Yen, Wan-Tai "Gold Cementation from Ammonium Thiosulfate Solution by Zinc, Cooper and Aluminium Powders"; Materials transactions, vol. 43, No. 3 (2002) pp. 485 to 493; 2002 The Mining and Materials Processing Institute of Japan.

(Continued)

*Primary Examiner* — Thomas M Lithgow
(74) *Attorney, Agent, or Firm* — Brent T. Winder; Jones Waldo Holbrook & McDonough, PC

(57) ABSTRACT

A method of extracting targeted metallic minerals from ores that contain sulfide metallic minerals along with oxide minerals, carbonate minerals, silicate minerals, halide minerals or combinations thereof. In the method, an ore slurry containing the metallic mineral in oxide, carbonate, silicate or halide form is provided. The slurry is activated by adding sodium thiosulfate and sodium metabisulfite, whereby the targeted metallic mineral forms an intermediary metal complex with the sodium thiosulfate and sodium metabisulfite. One or more metal release components are introduced into the ore slurry; whereby the targeted metallic mineral is released from the intermediary metal complex to form a metal sponge. This metal sponge is then subjected to a flotation process, whereby the targeted metallic mineral is drawn out of the ore slurry and thereby extracted from the ore.

20 Claims, 4 Drawing Sheets

(56) References Cited

U.S. PATENT DOCUMENTS

| | | | | |
|---|---|---|---|---|
| 3,524,724 | A | | 8/1970 | Every et al. |
| 3,843,771 | A | | 10/1974 | Urban |
| 3,893,915 | A | | 7/1975 | Mercade |
| 3,902,896 | A | | 9/1975 | Borbely et al. |
| 3,979,207 | A | | 9/1976 | MacGregor |
| 4,070,182 | A | | 1/1978 | Genik-Sas-Berezowsky et al. |
| 4,242,129 | A | | 12/1980 | Kellerwessel et al. |
| 4,256,706 | A | | 3/1981 | Heinen et al. |
| 4,269,622 | A | | 5/1981 | Kerley, Jr. |
| 4,289,532 | A | | 9/1981 | Matson et al. |
| 4,296,075 | A | | 10/1981 | Yan |
| 4,304,644 | A | | 12/1981 | Victorovich et al. |
| 4,369,061 | A | | 1/1983 | Kerley, Jr. |
| 4,384,889 | A | | 5/1983 | Wiewiorowski et al. |
| 4,411,612 | A | | 10/1983 | Holland |
| 4,411,873 | A | | 10/1983 | Yan |
| 4,489,984 | A | | 12/1984 | Savins |
| 4,510,027 | A | | 4/1985 | Wiewiorowski et al. |
| 4,552,589 | A | | 11/1985 | Mason et al. |
| 4,571,264 | A | | 2/1986 | Weir et al. |
| 4,578,163 | A | | 3/1986 | Kunter et al. |
| 4,585,561 | A | | 4/1986 | Zlokarnik et al. |
| 4,605,439 | A | | 8/1986 | Weir |
| 4,632,701 | A | | 12/1986 | Genik-Sas-Berezowsky et al. |
| 4,634,187 | A | | 1/1987 | Huff et al. |
| 4,654,078 | A | | 3/1987 | Perez et al. |
| 4,654,079 | A | | 3/1987 | Nunez et al. |
| 4,684,404 | A | | 8/1987 | Kalocsai |
| 4,721,526 | A | | 1/1988 | Elmore et al. |
| 4,723,998 | A | | 2/1988 | O'Neil |
| 4,738,718 | A | | 4/1988 | Bakshani et al. |
| 4,740,243 | A | | 4/1988 | Krebs-Yuill et al. |
| 4,765,827 | A | | 8/1988 | Clough et al. |
| 4,778,519 | A | | 10/1988 | Pesic |
| 4,801,329 | A | | 1/1989 | Clough et al. |
| 4,816,234 | A | | 3/1989 | Brison et al. |
| 4,816,235 | A | | 3/1989 | Pesic |
| 4,902,345 | A | | 2/1990 | Ball et al. |
| 4,913,730 | A | | 4/1990 | Deschenes et al. |
| 4,923,510 | A | | 5/1990 | Ramadorai et al. |
| 4,925,485 | A | | 5/1990 | Schulze |
| 4,980,134 | A | | 12/1990 | Butler |
| 5,051,128 | A | | 9/1991 | Kubo |
| 5,071,477 | A | | 12/1991 | Thomas et al. |
| 5,114,687 | A | | 5/1992 | Han et al. |
| 5,127,942 | A | | 7/1992 | Brierley et al. |
| 5,147,617 | A | | 9/1992 | Touro et al. |
| 5,147,618 | A | | 9/1992 | Touro et al. |
| 5,171,428 | A | * | 12/1992 | Beattie et al. ..... 209/166 |
| 5,215,575 | A | | 6/1993 | Butler |
| 5,232,490 | A | | 8/1993 | Bender et al. |
| 5,236,492 | A | | 8/1993 | Shaw et al. |
| 5,244,493 | A | | 9/1993 | Brierley et al. |
| 5,246,486 | A | | 9/1993 | Brierley et al. |
| 5,308,381 | A | | 5/1994 | Han et al. |
| 5,338,338 | A | | 8/1994 | Kohr |
| 5,354,359 | A | | 10/1994 | Wan et al. |
| 5,362,470 | A | | 11/1994 | Masutomi et al. |
| 5,364,453 | A | | 11/1994 | Kohr |
| 5,405,430 | A | | 4/1995 | Groves et al. |
| 5,443,621 | A | | 8/1995 | Kohr |
| 5,484,470 | A | | 1/1996 | Kristjansdottir et al. |
| 5,489,326 | A | | 2/1996 | Thomas et al. |
| 5,536,297 | A | | 7/1996 | Marchbank et al. |
| 5,536,480 | A | | 7/1996 | Simmons |
| 5,607,619 | A | | 3/1997 | Dadgar et al. |
| 5,626,647 | A | | 5/1997 | Kohr |
| 5,653,945 | A | | 8/1997 | Gathje et al. |
| 5,672,194 | A | | 9/1997 | Hunter et al. |
| 5,683,490 | A | | 11/1997 | Earley, III et al. |
| 5,733,431 | A | | 3/1998 | Green et al. |
| 5,785,736 | A | | 7/1998 | Thomas et al. |
| 5,876,588 | A | | 3/1999 | Lalancette et al. |
| 5,939,034 | A | | 8/1999 | Virnig et al. |
| 5,961,833 | A | | 10/1999 | Green et al. |
| 6,156,186 | A | | 12/2000 | Mueller et al. |
| 6,165,344 | A | | 12/2000 | Green et al. |
| 6,183,706 | B1 | | 2/2001 | King |
| 6,197,214 | B1 | | 3/2001 | Virnig et al. |
| 6,251,163 | B1 | | 6/2001 | King |
| 6,344,068 | B1 | | 2/2002 | Fleming et al. |
| 6,355,175 | B1 | | 3/2002 | Green et al. |
| 6,368,381 | B1 | | 4/2002 | King et al. |
| 6,451,275 | B1 | | 9/2002 | Fleming |
| 6,500,231 | B1 | | 12/2002 | Wan |
| 6,602,319 | B1 | | 8/2003 | Murthy et al. |
| 6,632,264 | B2 | | 10/2003 | Zhang et al. |
| 6,641,642 | B2 | | 11/2003 | Simmons et al. |
| 6,660,059 | B2 | | 12/2003 | Ji et al. |
| 7,066,983 | B2 | | 6/2006 | Ji et al. |
| 7,544,232 | B2 | | 6/2009 | Hackl et al. |
| 7,559,974 | B2 | | 7/2009 | Ji et al. |
| 8,097,227 | B2 | | 1/2012 | Hackl et al. |
| 2003/0154822 | A1 | | 8/2003 | Hall et al. |
| 2004/0206207 | A1 | | 10/2004 | Ji et al. |
| 2011/0155651 | A1 | * | 6/2011 | Gorain ..... 209/162 |
| 2014/0197076 | A1 | * | 7/2014 | Simmons ..... 209/4 |

OTHER PUBLICATIONS

U.S. Environmental Protection Agency Office of Solid Waste Special Waste Branch, Technical Resource Document Extraction and Beneficiation of Ores and Minerals, vol. 3, Iron. Aug. 1994. [Retrieved on Apr. 9, 2014] Retrieved from the internet: URL: < http://www.epa.gov/osw/nonhaz/industrial/special/mining/techdocs/iron.pdf>; p. 1-21/.

* cited by examiner

ACTIVATED FLOTATION CIRCUIT FOR PROCESSING COMBINED OXIDE AND SULFIDE ORES

PRIORITY

This application claims priority from U.S. provisional patent application Ser. No. 61/848,844 filed Jan. 14, 2013 which is hereby incorporated by reference for its supporting teachings.

BACKGROUND

In mining operations, the ores of any economic importance typically contain nonferrous metallic minerals as oxides, carbonates, sulfates, sulfides or as free metals. The treatment of low grade nonferrous metal ores in which a substantial part of the metallic minerals occur in oxide form presents a problem for recovery by conventional means because, unlike sulfide metallic minerals, oxide metallic minerals are not readily amenable to froth flotation methods. It is not uncommon that up to approximately 40% of the total metallic minerals contained in low grade nonferrous metal ores occurs in an oxide form. In some ores, as much as 81% of the total metallic mineral content is oxide minerals with the remainder being sulfides, silicates, carbonates, halides and as free metal. Because these oxide minerals cannot be extracted with conventional froth flotation methods, generally only the sulfide minerals and free metal particles are recovered in froth flotation processes leaving the oxide minerals unrecovered and sent to tails.

Converting the oxide minerals to sulfides is sometimes effective to render the oxide minerals amenable to froth flotation. For example, sodium sulfide is used to convert copper oxide ($Cu_2O$ and CuO), copper carbonates and copper halides into their sulfide form. Generally however, attempts at an industrial scale of operation to convert these minerals to sulfides produce low recoveries as oxide, carbonate, silicate and halide nonferrous mineral ores do not effectively react to this form of sulfide conversion in an industrial scale of operation. Thus, such chemical attempts at converting the oxide, carbonate, silicate and halide metallic minerals to a sulfide for flotation recovery are highly inefficient and cost-prohibitive because of low recovery rates.

Because of these inefficiencies, other means to recover the mineral values in the ore have been utilized. Most commonly, acid and cyanide heap leaching processes, batch acid leaching and solvent extraction-electrowinning (SX/EW) techniques were developed and utilized to recover oxide, carbonate, silicate and halide metallic minerals in low grade nonferrous metal ores. However, heap leaching has a number of inherent limitations that make it a less desirable process. For example, the amount of time required utilizing heap leach techniques to recover these minerals from ore is considerable—sometimes taking approximately a year to extract 70% of the oxide metallic minerals. The sulfide minerals and most of the precious metals are not recovered in the standard copper heap leach operation. Moreover, heap leaching can have a detrimental impact on sensitive areas of the environment and ecosystem. In particular, rivers, streams and lakes; the surrounding land; and water table can all be permanently damaged because of the inherent toxicity of the practice—so much so that some societies are banning the practice altogether.

Applicant has discovered that the addition of the lixiviant sodium thiosulfate modified with sodium metabisulfite to the ore pulp slurry in an alkaline circuit creates an intermediary metal complex with the oxide, carbonate, silicate and halide metallic minerals contained therein. When a metal release component is added to the solution, the metallic minerals are released from the metal complex and form a free metal sponge that is amenable to standard flotation recovery techniques utilized by those skilled in the art.

The use of sodium thiosulfate modified with sodium metabisulfite in combination with a metal release component has a number of distinct advantages that are not presently known or utilized in the art. For example, the present invention in its various embodiments is a process that allows for the simultaneous extraction of high yields of oxide metallic minerals; associated sulfide metallic minerals; carbonate minerals; silicate minerals; halide minerals; sulfate minerals; arsenide minerals; antimonide minerals; or combinations of the same; as well as associated native metals; precious metals; or combinations of the same from ore in a straight through pass. In particular, the process of the present invention allows a semi-oxide ore—i.e. an ore containing both oxide and sulfide minerals as well as carbonate, silicate, halide, sulfate, arsenide or antimonide minerals or combinations thereof—to be treated such that the oxide, carbonate, silicate and halide metallic minerals are made amenable for conventional flotation with the sulfide, sulfate, arsenide, antimonide, free metal and precious metals that are contained therewith and that are already amenable to flotation. All phases of treatment can performed in the ore pulp slurry which eliminates the necessity of separating a leach solution from the solids for further treatment as is required in current acid leaching and SX techniques for oxide minerals. The process of the present invention may effectively eliminate inefficient heap leach operations their associated costs and environmental damages and achieve higher yields in a shorter period of time.

The process of the present invention allows for much lower extraction costs and quicker mineral recoveries. The process also makes viable ore stocks that contain such high levels of oxide metallic minerals as to previously make them unsuitable for extraction by conventional flotation operations. The process also has low toxicity.

In addition to the foregoing advantages, the present process improves metal recovery from standard sulfide metal recovery processes. In particular, as ores are milled prior to flotation, oftentimes the sulfide metallic minerals are contaminated with or deteriorated by oxides. These minerals include, but are not limited to tungsten, silver, gold, molybdenum, and copper minerals such as chalcocite and chalcopyrite. This contamination/deterioration reduces the effectiveness of flotation recovery because, as is known in the art, oxides are not responsive to conventional flotation recovery techniques. The use of sodium thiosulfate modified with sodium metabisulfite effectively cleans such oxide contaminants off the sulfide minerals making them more responsive to flotation extraction. Thus, beyond making previously inaccessible ores suitable for flotation recovery (i.e. metallic mineral oxides), the present process increases the efficiency of existing metal sulfide recovery processes.

The addition of sodium thiosulfate and sodium metabisulfite to an ore pulp slurry is also advantageous in that it draws off a large percentage of toxic elements such that they are not mingled with the desired metals when extracted. The toxic metals that respond in this manner include, but are not limited to arsenic, lead and fluorine. These toxins are encapsulated by the modified lixiviant reagents but do not precipitate out when the metal release component is added. Thus, they are not mingled with the desired metals in the extraction process but instead continue downstream to tails.

The present invention in its various embodiments also allows for improved recovery of magnetite. In particular, when magnetite recovery is desired, it is typically done at the early stages of ore processing. This can result in loss of valued metals. The present process allows the recovery of magnetite at the end of the flotation process.

The foregoing advantages as well as others are provided for by the invention in its various embodiments.

It is initially noted that the term "metallic minerals" as used herein includes all nonferrous metallic minerals including but not limited to include, copper, nickel, vanadium, uranium, molybdenum, tungsten, tin, zinc, aluminum, mercury, magnesium, manganese, chromium, gold, silver as well as the platinum group metals all of which are considered recoverable through the process of the present invention.

SUMMARY OF THE INVENTION

The present invention in its various embodiments is a method of extracting targeted metallic minerals from ores that contain sulfide metallic minerals along with oxide minerals, carbonate minerals, silicate minerals, halide minerals or combinations thereof. In the method, an ore slurry containing the metallic mineral in oxide, carbonate, silicate or halide form is provided. The slurry is activated by adding sodium thiosulfate and sodium metabisulfite, whereby the targeted metallic mineral forms an intermediary metal complex with the sodium thiosulfate and sodium metabisulfite. One or more metal release components are introduced into the ore slurry; whereby the targeted metallic mineral is released from the intermediary metal complex to form a metal sponge. This metal sponge is then subjected to a flotation process, whereby the targeted metallic mineral is drawn out of the ore slurry and thereby extracted from the ore.

In certain embodiments, the metal release component is one or more precipitants selected from the group consisting of iron, copper, zinc, carbon, aluminum, sodium sulfate, calcium sulfate and sulfur dioxide. The metallic minerals that can be extracted with the present process in its various embodiments include, but are not limited to copper, nickel, vanadium, uranium, molybdenum, tungsten, tin, zinc, aluminum, mercury, magnesium, manganese, chromium, gold, silver, platinum, palladium and rhodium.

In certain embodiments, the sodium thiosulfate and sodium metabisulfite are added to the ore slurry during milling.

In certain embodiments, the ore slurry is approximately 25% solids by weight. In yet other embodiments, the sodium thiosulfate constitutes approximately 2%-6% by weight of the slurry. In yet other embodiments, the sodium metabisulfite is added in sufficient quantities as to bring the pH of the slurry to approximately 5.5 to 6.0.

Various particle sizes respond well to the present process; but it has been found that particle sizes of approximately 150-65 mill grade mesh are particularly well suited for use with the present invention.

In some embodiments, the sodium thiosulfate, sodium metabisulfite and metal release components are added in a single mixing vessel. In other embodiments, the sodium thiosulfate, sodium metabisulfite and metal release components are added in multiple mixing vessels. The sodium thiosulfate and sodium metabisulfite can be allowed to mix for a predetermined time prior to adding the metal release component.

The metal release component can be in a variety of shapes, sizes and configurations. For example, it can be iron powder. It can be substantially rod-shaped. It can be geometrically shaped or a screen.

DETAILED DESCRIPTION OF THE ILLUSTRATED EMBODIMENTS

Figure 1:
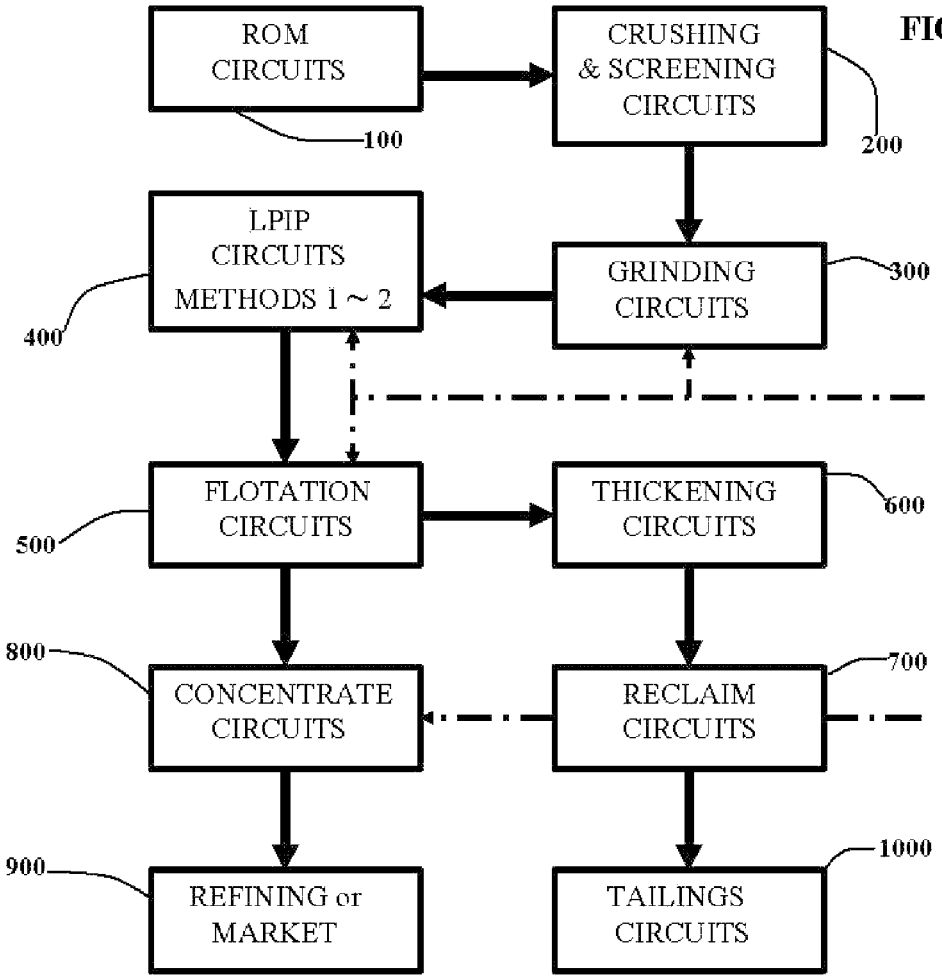
FIG. 1 shows an overview flow chart of the activated flotation circuit process according to one embodiment of the present invention for an alkaline circuit or an acid circuit.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring now to FIG. 1, a flow chart illustrating circuitry of various aspects of the activated flotation process is shown according to one embodiment of the present invention. The process generally includes one or more run of mill (ROM) circuits 100; one or more crushing and screening circuits 200; one or more grinding circuits 300; one or more Leach Precipitate In Pulp (LPIP) circuits 400; one or more flotation circuits 500; one or more thickening circuits 600; one or more reclamation circuits 700; one or more concentration circuits 800; one or more refining or market circuits 900; and one or more tailings circuits 1000.

It is initially noted that the comminution circuitry used herein—i.e. ROM circuitry 100; crushing and screening circuitry 200; and grinding circuitry 300—is well known in the art and the present invention is not intended to be limited to any particular steps or configurations in these circuits. Illustrative examples of obtaining the desired grain size and slurry concentration for the activated flotation circuit of the present invention are described below; but it is noted that numerous other methods and configurations as would be apparent to one skilled in the art could be utilized to that same end.

Similarly, the flotation and subsequent circuits—i.e. flotation circuits 500; thickening circuits 600; reclaim circuits 700; concentrate circuits 800 and refining or market circuits 900—are likewise well known in the art and the present invention is not intended to be limited to any particular steps or configurations in these circuits. Illustrative examples are described below; but it is noted that numerous other methods and configurations as would be apparent to one skilled in the art could be utilized to that same end.

It is also noted that, while the flow diagram of FIG. 1 may be read to suggest that all ores pass through ROM circuits 100; crushing and screening circuits 200; and grinding circuits 300, that is not necessarily the case. In some instances, depending on the size of material in an existing ore stockpile, a run of mill (ROM) (depicted at 100) or run-of-stockpile straight to the grinding circuit 300 may be suitable. The configuration of FIG. 1 is only illustrative and numerous configurations and circuitry to end up at the desired grain size would be apparent to one skilled in the art.

It is also noted that the terms "leach" and "precipitate" as they relate to circuit 400 or as discussed elsewhere herein are consistent with the use of these terms in the relevant art. However, the scope of the present invention is not intended to be limited to a narrow construction of these terms or any particular underlying metallurgical reaction.

Figure 2:
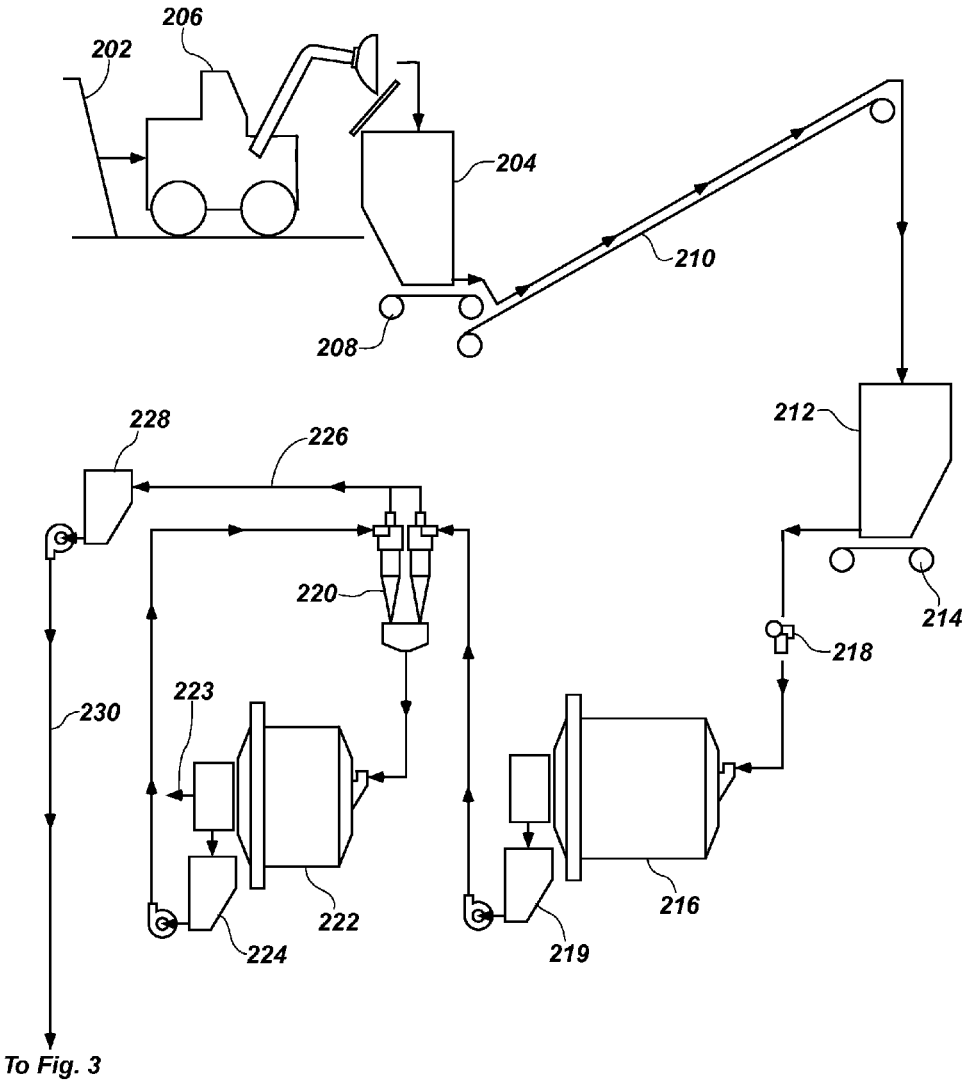
FIG. 2 is a schematic depiction of crushing, screening and grinding circuitry suitable for use in connection with certain embodiments of the present invention.

As is depicted schematically in FIG. 2, in one embodiment, the stockpile ore 202 can be brought to a load out hopper 204 by a loader 206 or other known conveyance mechanism. Ore is carried from the hopper 204 on a belt feeder 208 to a mill feed conveyor 210. The ore is then deposited into a mill feed ore bin 212 for temporary storage. When processed for extraction, the ore is conveyed from the bin 212 on another belt feeder 214 to a rod mill 216 where it is ground to a size of approximately ten (10) mesh (approximately 1-2 mm). Prior to milling, an automatic sampler 218 can be employed to continuously sample the ore being processed. Thus, the downstream treatment operation can be adjusted as needed and the quality of ore being processed can be known and compared to the recovery values attained. It is also noted that prior to milling, it is often necessary to crush the ore to a suitable mill feed—typically feed sizes of less than two inches in diameter.

In certain instances, instead of a rod mill 216, it may be desirable to utilize a semi autogenously grind (SAG) or a one stage grinding circuit or combinations of the same. The actual grinding mechanism utilized is as required to meet the proper grind index of the ore to be processed. The proper grind index would be apparent to one of ordinary skill in the art.

Once ground, the ore slurry can be temporarily stored in bin 219 after which it is pumped through a hydrocyclone classifier 220 for classification by particle size. The oversize particles can be re-circulated back to the grinding circuit for further milling, after which they can be redirected to the classifier 220. The slurry (represented at 226) containing the smaller, suitably sized particles, is sent downstream for the next phase of the process.

In the embodiment shown in FIG. 2, the larger pieces are dropped out of the hydrocyclone classifier 220 and directed to a ball mill 222 for additional grinding. Once ground, the ore slurry is deposited in bin 224 and then directed back to the classifier 220. Rock rejected from the ball mill 222 can be sent (depicted at 223) to a cone or other suitable crusher (not shown) as would be apparent to one skilled in the art, and then returned to the grinding circuit described. As would be apparent to one skilled in the art, given the possibility of wet, sticky ores being processed, crushing and grinding equipment would need to be able to accommodate such materials.

The foregoing example discusses a two stage mill circuit. However, in some cases, a two stage mill circuit is not required. For example, in one embodiment, a single closed mill circuit can be utilized. Such adjustments to milling circuit configurations would be apparent to one skilled in the art. Numerous other grinding circuit configurations as would be apparent to one skilled in the art would be suitable for use with the present invention.

It has been discovered that ore is most responsive to the LPIP circuit extraction process when the grains are approximately (−)65 mesh (mill grade) with the preferred range being between 150 and 65 mesh. However, in some instances, smaller or larger particle sizes may be desirable. For example, in certain embodiments, particle sizes as large as 20 mesh may be desirable. In other embodiments, particle sizes as small as 300 mesh may be desirable. Generally, particles that are too large do not leach well in a continuous operation and particles that are too small will hinder flotation.

After the course ore is broken down to the desired size, slurry 226 can be deposited in a bin, pump box or some other suitable storage container 228. Depending on the concentration, water may be added to create a second pulp slurry 230. In one embodiment, a pulp slurry 230 of approximately 25% solids has been found to work well for the extraction process. However, the percent solids can be as low as approximately 10% and as high as approximately 60%. The liquid of the slurry 230 at this stage of the process is most typically water. The water can be derived from numerous sources including, but not limited to, fresh water, process water (i.e. water that is re-circulated from the process); mine water (i.e. water that comes from a mine); and tailings water (i.e. water that comes from the tailings impoundment).

In certain embodiments, the activating reagents—i.e. the sodium thiosulfate and sodium metabisulfite in an alkaline circuit—are added during the milling process. This can be advantageous in certain circumstances as it allows a thorough mixing and grinding of the reagents in with the ore thus improving reactivity. It is also noted that, in certain circumstances, other stabilizing reagents such as pH control reagents may have also been added by this point.

In other embodiments, ground dry ores of the desired particle sizes could be directly mixed with water(s) or other suitable liquids to form a slurry amenable to the LPIP and subsequent circuits. In other words, under the present invention, it is not necessary that there be an initial slurry 226 formed at the grinding circuit or at any particular time prior to the LPIP circuit. Rather, the grinding—with or without the activation reagents—could be done completely separately or off-site and then the dry or substantially dry grains could be mixed with the necessary liquids to form a slurry 230 just prior to its introduction into the LPIP circuits; or the slurry could be formed in the LPIP vessel itself.

Figure 3:
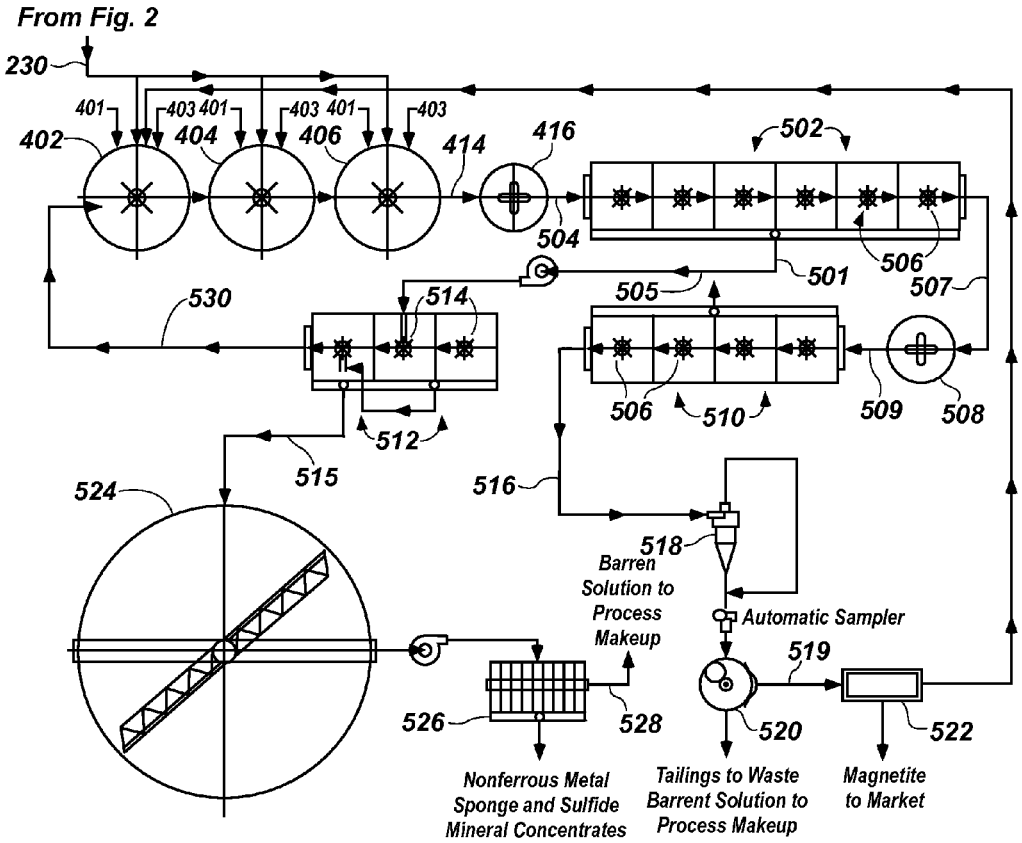
FIG. 3 is a schematic depiction of LPIP, flotation, thickening, reclamation, concentration, refining/market and tailings circuitry suitable for use in connection with certain embodiments of the present invention.

Referring now to FIG. 3, the slurry or pulp 230 is activated by combining it with the activation reagents (which in the presently discussed embodiment is sodium thiosulfate modified/sodium metabisulfite) and a metal release component. In this embodiment, the slurry is pumped into the LPIP circuit by conventional pumping means. Other mechanisms for directing the slurry 230 to the LPIP circuit would be apparent to one skilled in the art.

While not intending to limit the presently claimed process to any particular underlying metallurgical reaction, it is believed that adding the activating reagents to the pulp slurry 230 at this stage selectively bonds and creates a metal complex whereby the activating reagents function as a ligand. When a metal release component is added, the metals from the oxide, carbonate, silicate and halide metallic minerals in the ore are released from the metal complex to precipitate out as a metal sponge in the pulp that may be captured by conventional flotation techniques as discussed further below. Again, while not intending to limit the present invention to any particular underlying reaction, it is believed that this sponge formation occurs by the chemical process known as cementation.

One advantage of the present invention is that it allows for the leaching and precipitation of the metallic minerals in a single vessel 402 which in the present embodiment is a tank and mixer. This allows for a much more efficient and consequently more profitable recovery process. As can be seen in FIG. 3, in certain embodiments, multiple LPIP vessels 402, 404, 406 can be placed in tandem to ensure even greater recovery.

It is noted that, in some circumstances, dilute mineral acid such as sulfuric acid may be used to modify the sodium thiosulfate in an alkaline circuit such that it is able to form the desired metal complex. However, an important advantage of using sodium metabisulfite as the pH modifier is that it is nontoxic and eco-friendly. It has also been discovered that sodium metabisulfite is advantageous in that it does not deteriorate the sodium thiosulfate. Mineral acids, on the other hand, tend to deteriorate the sodium thiosulfate thereby impairing the effectiveness of the process.

A number of metal release components have been shown to be suitable for use in connection with the present invention. These include, but are not limited to iron, copper, zinc, carbon, aluminum, sodium sulfate, calcium sulfate, sulfur dioxide and combinations of the same.

It is not necessary that the activating reagents and metal release component be added to the slurry 230 in any particular order although the process proceeds in a forward reaction of leach then precipitate. Typically, the activating reagents will be added first and the metal release component added next. In other circumstances, the metal release component will be added to the slurry 230 substantially simultaneously with the activating reagents. The reaction continues until the leaching ceases or the metal release component is exhausted. As noted previously, this method is advantageous in that it eliminates two separate operations of leach then precipitate in separate vessels—which makes the process simpler to facilitate in practice on an industrial scale.

Figure 4:
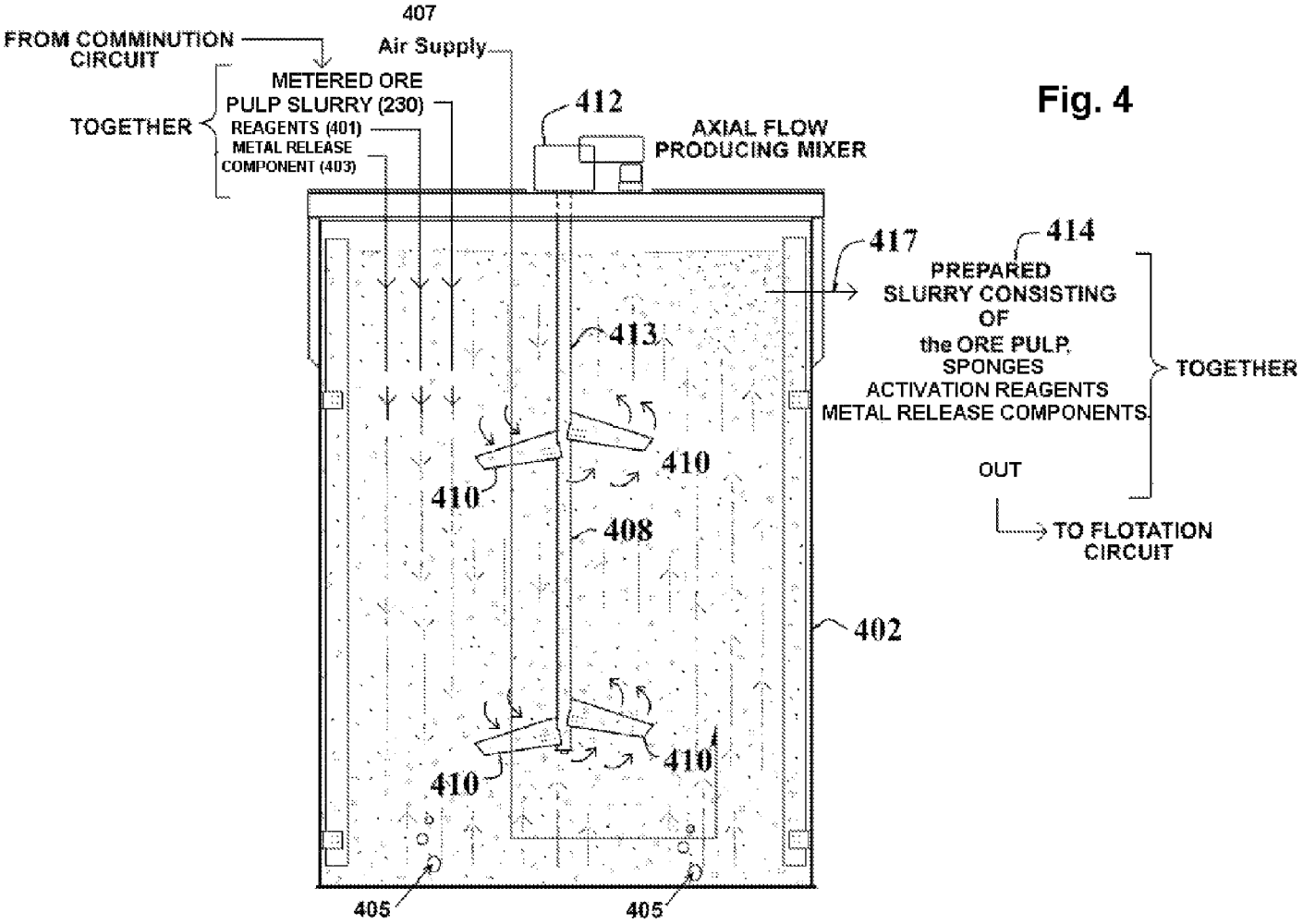
FIG. 4 is a depiction of a suitable LPIP vessel according to one embodiment of the present invention.

As is better scene in FIG. 4, an illustration of an alkaline circuit is shown; though as discussed further below, the same or a similar configuration would also be well suited for an acid circuit. A measure of the ore pulp slurry 230 is combined with activation reagents 401 and a metal release component 403 in vessel 402. The amount of slurry 230 deposited into the vessel 402 can be metered by conventional means known to one skilled in the art including, but not limited to a flow meter, metering pump, and tank level indicator device. The vessel 402 in an alkaline circuit is not required to be a solvent proof tank (for an acid circuit, the vessel would preferably be substantially fabricated and made to be resistant and nonreactive to mineral acid solvents). Suitable vessels for use with the present invention are standard equipment utilized in the mining industry and would be apparent to those skilled in the art.

In the present embodiment, the vessel 402 is equipped with a mixer 413. In this embodiment, the mixer is a single shaft mixer driven by motor 412. The mixer 413 can include one or more propellers 410 that produce a substantially axial pulp flow as indicated. The vertical flow of slurry in the vessel allows thorough contact of the particles during the LPIP phase of the process. However, it is noted that numerous other mixing configurations as would be apparent to one skilled in the art would be suitable for use with the present invention. In one embodiment, air bubbles 405 are also introduced into the vessel 402. In this embodiment, the bubbles 405 are introduced from the bottom of vessel 402. However, in other configurations, the bubbles 405 may be introduced at other locations in the vessel 402. It is also noted that other gases could be bubbled through the pulp slurry as it is mixed including, but not limited to pure oxygen; air supplemented with pure oxygen; or air with and oxygen content of at least 22%. The bubbles 405 aid in the formation of the metal complexes.

LPIP vessels can be operated independently or, as noted previously, multiple vessels 402, 404, 406 can be operated in tandem as required to meet the operating volumes dictated by the amount of slurry being processed.

As the pulp slurry 230, activation reagents 401 and metal release component 403 mixes, it becomes a third pulp slurry 414 that includes the ore pulp, metal sulfides and free metal contained therein as well as the precipitated or sponge metals and the metal release component. This third slurry is then directed out of the vessel 402 as indicated by arrow 417 as it moves along the axial flow line. The amount of time the pulp slurry 230, activation reagents 401 and metal release component 403 mixes can vary depending on a number of factors including the volume of the vessel 402 and slurry being processed; the speed of the mixer 413; the size of the propellers 410; etc. However, in a standard mixing configuration, a mix time of approximately 20-30 minutes has been shown to be an effective amount in the presently illustrated embodiment with an optimal time being approximately 23 minutes. It is noted that excessive mixing times can cause the metal sponges to reform into metal complexes with the activation reagents. Thus, a quick pass through of the process is generally preferred as too much mixing can impair the effectiveness of the present process.

As noted previously, when the third slurry 414 leaves the vessel 402 it could go to subsequent circuits in the flotation process; or it could go into tandem LPIP vessels 404, 406 to maximize metal recovery.

An important advantage of the present invention is that the sodium thiosulfate modified with sodium metabisulfite allows for selective leaching of the targeted metallic minerals—i.e. the oxide, silicate, carbonate and halide nonferrous metals of an ore sample. As noted previously, these metals are then precipitated out of solution as metallic particles known in the industry as metal sponge that form by the accretion of like particles and settling out of solution into the pulp slurry. As also noted previously, this entire reaction can occur in a single vessel—which can be advantageous and is unique to this invention; but is not intended to be limiting (i.e. the entire reaction does not need to occur in a single vessel but is the preferred method of this invention). For example, in some circumstances, it may be desirable to introduce the pulp slurry into a first tank and add only the metal release component. Then, that mixture could be sent to a separate tank where only precipitant is added. Such an embodiment is considered to be within the scope of the present invention.

Nevertheless, all phases of treatment are performed in the pulp slurry. This eliminates burdensome processes utilized in the current state of the art for processing semi-oxidized nonferrous metallic ores (such as heap leach followed by solvent extraction (SX) and electro winning (EW) extraction methods where loaded leach solutions must be decanted from the leached ore solids for further specialized recovery treatment). The present invention allows for the added benefit of being able to recover the sulfide minerals, sulfates, arsenides, antimonides and free metals that may be contained in the ore through a common flotation process.

While not intending to limit the present invention to any particular underlying metallurgical reaction, it has been observed that the addition of sodium thiosulfate and sodium metabisulfite forms a metal complex that is an intermediate complex which, when a metal release component is added, spontaneously decomposes to release the targeted nonferrous metal in a forward reaction according to the following reaction formula:

$$AB+C \rightarrow ABCx \rightarrow Az+BC$$

Where A represents the metallic oxide, carbonate, silicate or halide; B represents the activation reagent; and C represents the metal release component. ABCx represents the activated coordination or intermediate complex and Az represents the displaced/precipitated metal.

Thus, in an alkaline flotation scenario, where sodium thiosulfate (Na2S2O35H2O) and sodium metabisulfite (NaS2O5) and elemental iron (Fe) (as a metal release component) are added to a pulp slurry containing the copper oxide silicate Chrysocolla (CuSiO32H2O), the foregoing equation can be expressed by process:

CuSiO32H2O(Na2S2O35H2O+NaS2O5)+Fe→CuSiO32H2O(Na2S2O35H2O+NaS2O5)Fe→Cu+SiO32H2O(Na2S2O35H2O+NaS2O5)Fe

In an alkaline flotation scenario, where sodium thiosulfate (Na2S2O35H2O) and sodium metabisulfite (NaS2O5) and elemental iron (Fe) (as a metal release component) are added to a pulp slurry containing the mineral Malachite (CuCO3) carbonate of copper, it can be expressed as:

CuCO3(Na2S2O35H2O+NaS2O5)+Fe→CuCO3(Na2S2O35H2O+NaS2O5)Fe→Cu+CO3(Na2S2O35H2O+NaS2O5)Fe

In an alkaline flotation scenario, where sodium thiosulfate (Na2S2O35H2O) and sodium metabisulfite (NaS2O5) and elemental iron (Fe) are added to a pulp slurry containing the halide mineral atacamite ($Cu_2(OH)_3Cl$), it can be expressed as:

$Cu_2(OH)_3Cl$(Na2S2O35H2O+NaS2O5)+Fe→$Cu_2(OH)_3Cl$(Na2S2O35H2O+NaS2O5)Fe→Cu+$OH_3Cl$(Na2S2O35H2O+NaS2O5)Fe

In an alkaline flotation scenario, sodium thiosulfate (Na2S2O35H2O) and sodium metabisulfite (NaS2O5) and elemental iron (Fe) are added to a pulp slurry containing the metallic mineral Molybdenite (MoS2), a sulfide of Molybdenum. Molybdenite, being a sulfide, does not undergo the leach and precipitate process but reports with the slurry to the flotation circuit where it is recovered as a value component of a salable concentrate.

In an alkaline flotation scenario, sodium thiosulfate (Na2S2O35H2O) and sodium metabisulfite (NaS2O5) and elemental iron (Fe) are added to a pulp slurry containing the metallic mineral Argentite (Ag2S), a sulfide of Silver. Argentite, being a sulfide does not undergo the leach and precipitate process but reports with the slurry to the flotation circuit where it is recovered as a value component of a salable concentrate.

In an alkaline flotation scenario, sodium thiosulfate (Na2S2O35H2O) and sodium metabisulfite (NaS2O5) and elemental iron (Fe) are added to a pulp slurry containing the Native Metals of Gold [Au], Silver [Ag], Copper [Cu], Platinum [Pt], or Electrum [Au/Ag combined]. Being native metal particles, these do not undergo the leach and precipitate process but report with the slurry to the flotation circuit where they are recovered as a value component of a salable concentrate.

In an alkaline flotation scenario, where sodium thiosulfate (Na2S2O35H2O) and sodium metabisulfite (NaS2O5) and elemental iron (Fe) (as a metal release component) are added to a pulp slurry containing nickel oxide in the form of Lateritic Nickel Ore of the Limonite and Silicate type, it can be expressed as:

NiO(Na2S2O35H2O+NaS2O5)+Fe→NiO(Na2S2O35H2O+NaS2O5)Fe→Ni+FeNa2S2O35H2O+NaS2O5

In an alkaline flotation scenario, where sodium thiosulfate (Na2S2O35H2O) and sodium metabisulfite (NaS2O5) (as a metal release component) and elemental iron (Fe) (as a precipitant) are added to a pulp slurry containing zinc oxide in the form of the zinc ore mineral Zincite (ZnO), it can be expressed as:

ZnO(Na2S2O35H2O+NaS2O5)+Fe→ZnO(Na2S2O35H2O+NaS2O5)Fe→Zn+(Na2S2O35H2O+NaS2O5)Fe

In an alkaline flotation scenario, where sodium thiosulfate (Na2S2O35H2O) and sodium metabisulfite (NaS2O5) and elemental Magnesium (Mg) (as a metal release component) are added to a pulp slurry containing tin oxide in the form of the tin ore mineral Cassiterite (SnO2), it can be expressed as:

ZnO2(Na2S2O35H2O+NaS2O5)+Mg→ZnO2(Na2S2O35H2O+NaS2O5)Mg→Zn+(Na2S2O35H2O+NaS2O5)Mg

In an alkaline flotation scenario, where sodium thiosulfate (Na2S2O35H2O) and sodium metabisulfite (NaS2O5) and elemental iron (Fe) (as a metal release component) are added to a pulp slurry containing uranium oxide in the form of the uranium ore mineral Carnotite ($K_2(UO_2)_2(VO_4)_2.3H_2O$), it can be expressed as:

$K_2(UO_2)_2(VO_4)_2.3H_2O$(Na2S2O35H2O+NaS2O5)+Fe→$K_2(UO_2)_2(VO_4)_2.3H_2O$(Na2S2O35H2O+NaS2O5)Fe→U+(Na2S2O35H2O+NaS2O5)Fe

Incorporating the comminution circuits and subsequent processing circuits (including the flotation circuit), the entire process according to one embodiment of the present invention could be characterized according to the following formula:

Comminution Circuits>LPIP Circuits (AB+C→ABCx→Az+BC)+D+E+F>Flotation Concentration>Thickening>Filtering>Lixiviant Treatment>pH Treatment>Tails Sequestration With this, A represents the metallic oxide, silicates, carbonate and/or halide minerals; B represents the activation reagents; and C represents the metal release component. ABCx represents the activated complex. Az represents the displaced or precipitated metal. D represents metallic sulfides; E represents free metal in ore; and F represents residual pulp.

Referring again to FIGS. 3 and 4, after the metal is leached (or dissolved for an acid circuit) from its oxide, silicate, carbonate and halide form and precipitated out as a metal sponge, the entire pulp slurry 414 containing the precipitated sponge nonferrous metal, the insoluble nonferrous sulfide minerals, any free metals from the ore, along with the pulp, activation reagents and metal release components are sent to a flotation circuit in a single, continuous stream whereby the nonferrous metals and nonferrous sulfide minerals are recovered by flotation from the pulp slurry as a nonferrous concentrate.

Nonferrous metals that can be extracted through the present process are all metallic minerals that are higher than iron on the electrochemical scale of metals, including but not limited to, Cu, Au, Ag, Mo, Ni, Zn, Sn, Pt, Pd, Rh, U, Mg, Mn and W in their various oxidized, silicate, carbonate, halide, sulfide and native metal forms. It is important to note that the present process allows for the simultaneous recovery of all the foregoing metals in a single process. Thus, the present invention allows for high metal recovery and operates with exceptional efficiency.

As depicted in FIG. 3, prior to entering the flotation circuit 502, slurry 414 can be directed to a conditioner tank 416 where it is treated with various reagents standard to the industry and known by those skilled in the art—typically a collector reagent and a frothing reagent—to condition the slurry 414 for flotation that includes but is not limited to pH control as required. It is noted that conditioning is a known and commonly used technique to prime the sulfide, converted and native metal particles for extraction during the flotation process. Conditioning reagents can also be added to depress or retard unwanted mineral particles that are in the pulp slurry from entering the desired flotation concentrate. For example, it may be desirable to depress the metal release components utilized in the LPIP process such as iron.

Conditioning reagents are standard to the industry and known by those skilled in the art. Those suitable for use with the present invention include but are not limited to frothers (pine oil, polypropylene glycol and derivatives); promoters (aliphatic dithiophosphates, xanthate and derivatives); depressants/pH modifiers (lime, sodium sulfite, sodium metabisulfite and/or sodium silicate); activators (sodium metabisulfite); sulfidizers (sodium sulfide); regulators (lime and sodium silicate); and combinations of the same. The order of these groups is no indication of their relative importance; and it is common for some reagents to fall into more than one group. The conditioner tank 416 typically includes an agitator and allows positive recirculation of the pulp in the tank 416.

After conditioning, the conditioned slurry 504 is directed to a flotation circuit. The pH of the flotation feed is important for optimum froth conditions and metals recovery. Neither too low nor too high a pH is desirable. However, the appropriate pH of the flotation circuit being utilized would be apparent to one skilled in the art. For example, for copper extraction in an alkaline circuit—where sodium thiosulfate and sodium metabisulfite is used as the activation reagent and iron as the metal release component—a pH of approximately 8.0~9.0 (plus or minus 0.5) has been found to be an effective pH for the flotation feed. A pH of approximately 4.0~4.5 (plus or minus 0.5) has been found to be an effective pH for an acid flotation circuit where sulfuric acid is the solvent and iron the precipitant. Numerous other parameters for the flotation circuit would be apparent to one skilled in the art. The pH of the flotation feed can be adjusted by numerous known reagents including, but not limited to, those modifiers listed above.

It is noted that, in certain embodiments of the present invention, the addition of the activation reagents in combination with the metal release component can optimize the pH for the subsequent flotation feed. Thus, fewer adjustments with reagents are necessary for optimal flotation feed pH which reduces operational expense. Moreover, an optimized slurry can depress Fe minerals in the pulp slurry thereby limiting the amount of Fe minerals that are in the concentrate. It is believed that oxidation-reduction reactions between the metallic oxide particle and the metal release component account for this change.

In FIG. 3, the flotation circuit is depicted as a two stage froth flotation circuit—the first stage 502 comprising a series of multiple free flow machines 506; the second stage 512 comprising a series of cell to cell flotation machines 514. As is known in the art, in a flotation circuit the metal sulfides separate from the waste gangue by adhering to gas (typically air) bubbles as they pass through the pulp slurry in the presence of certain reagents and conditioners. It has been discovered that the metal sponge particles of the present invention are similarly responsive to flotation methods. Thus, a user can, from a single flotation circuit, obtain the sulfide forms of the metallic minerals in an ore as well as those metallic minerals that were previously nonresponsive to flotation (i.e. the metallic minerals that were leached and then precipitated out of their oxide, silicate, halide and carbonate forms).

In the illustrated embodiment, the conditioned slurry 504 is directed through the first flotation stage 502. The clean concentrates obtained from this first flotation stage containing the leached oxide, silicate, halide or carbonate minerals that were precipitated as metal sponge; the sulfide minerals; and other metallic values contained in the concentrates, are removed and sent to a thickener (not shown). The quality of recovered values in the rougher concentrate dictates whether the rougher concentrate is further processed in a downstream flotation circuit or sent to market and sold. In other words, if the percentage of values is high enough no further concentrating is required. If the rougher concentrate does not contain a high percentage of values it is further processed to achieve a higher grade of values in the concentrate.

The concentrate is thickened and then removed from the thickener tank and filtered to remove additional liquids. The dehydrated concentrate at approximately 10% moisture content is ready to be shipped off site and sold to a smelter or to other means of refining.

The rougher and scavenger concentrates 501 are pumped or otherwise conveyed to the second flotation stage 512 where further recovery and extraction is accomplished. As depicted schematically in FIG. 3, after the second flotation stage 512, the concentrated metals 515 are directed to thickener 524 and then filtered 526 by known techniques (in this illustration, a disc filter) leaving a nonferrous metal sponge, metallics and sulfide mineral concentrate that can then be sent to market. The barren solution 528 is then sent to process makeup that is reused in the operation.

As depicted at 530, remaining pulp that still contains metallic particles utilized for the metal release component can be recovered and separated from the pulp prior to tails by a magnetic separator or other device standard to the industry and known to those skilled in the art; whereby it can be sent back to the LPIP circuits and reused for that process.

The pulp slurry (middlings) 507 from the first stage 502 of flotation cells may be directed to a second conditioner tank 508 and treated with additional amounts of the required reagents that may include but are not limited to frothers, promoters, depressants, activators, sulfidizers, regulators and pH control additives. The reconditioned slurry 509 is then run through flotation bank 510 where scavenged concentrates are removed from flotation circuit 510. Then the reconditioned slurry, along with rougher concentrates 501, is pumped or otherwise conveyed to a third flotation circuit 512 (a cleaner circuit) where further recovery of a more refined concentrate is accomplished.

As is illustrated in FIG. 3, once the metallic minerals have been extracted through the first rounds of flotation, the pulp slurry tails may then be directed 516, to a hydro cyclone classifier 518 and then to a magnetic separator 520, or other similar separating equipment as would be apparent to one skilled in the art, where the metal release component and magnetic elements such as magnetite contained in the pulp slurry are removed. At this step the metal release component that is collected can be reused in the LPIP portion of the process and the magnetite can be packaged and sold. Similar recovery can be made of excess iron that may have been added to prevent re-solution of the precipitated metal.

Ferrous minerals purposely depressed by retardant chemicals contained in the ore pulp that are amenable to magnetic separation 520 may also be recovered as a saleable product prior to final tails. Pulp slurry from the magnetic separator 520, for example, is screened 522 and then reports as final tails where it is sequestered in proper impoundments standard to the industry and known by those skilled in the art.

It is noted that the ability to recover magnetite at the end of the process is considered a unique advantage of the present invention in its various embodiments. In particular, magnetite is an independently salable byproduct of metallic mineral recovery. However, the industry standard for magnetite recovery, when desired, is recovery at the beginning stages of ore processing. This is problematic because early recovery can inadvertently result in the removal of desirable metals including, but not limited to, precious metals and copper—which are then no longer available for downstream extraction. The amount of metals lost in this manner is not large; but over the life of a mining operation can result in considerable loss. In the present process, the magnetite is believed to be encapsulated by the metal complexes such that it does not precipitate out when the metal release component is added. The precipitation of the magnetite can be further depressed by known depressants. Thus, the magnetite is carried through to the tails where it can be recovered by magnetic separators or other known means.

It is also noted that in certain circumstances, it may be desirable to include more or fewer flotation machines 502, 506, 514. It may be desirable in certain circumstances to have only a single stage of flotation machines. It may be desirable in certain circumstances to have more than two stages of flotation machines depending on the ore matrix and the volume of ore that is to be processed.

It is also noted that the present process is depicted as a froth flotation circuit. However, the present process could be utilized in connection with other flotation methods including, but not limited to, standard cell flotation equipment and pneumatic lift agitation vertical cell equipment. Flotation circuitry is well known and numerous other flotation circuit equipment and configurations that would be suitable for use with the present invention would be apparent to one skilled in the art.

As noted above, the particle size can effectively be between approximately 300 mesh and 20 mesh (mill grade). However, it has been discovered that, for both alkaline and acid circuits, particle sizes of approximately 150 to 65 mesh are particularly well suited for the LPIP process and those processes downstream. While finer grinds may be desirable in certain circumstances, they are more likely to produce slimes that are not generally desirable.

It has also been discovered in both alkaline and acid circuits that while concentrations of solids in the pulp can effectively be as low as 10% by weight and as high as 60%, approximately 25% solids by weight is particularly well suited for both the LPIP circuit and flotation. Solid concentrations that are even lower will respond well to the LPIP process; however, such operations are not generally economically viable. Higher solid concentrations may be desirable in certain circumstances. However, such concentrations tend to sand up in the tanks, flotation operations and thickeners.

For the activation reagents, the preferred concentration of sodium thiosulfate is approximately 2%-6% of the total slurry weight. The optimal amount added to the pulp slurry has been found to be approximately 4% by weight. However, it is noted that both higher and lower concentrations are considered to be within the scope of the present invention. The lower limits are only set by what would be industrially applicable. Concentrations of less than 2% sodium thiosulfate would work; but tend to make the operation of the process not economically viable as metal recoveries are not sufficient to justify the process. High concentrations of sodium thiosulfate would also work; but may not be economically viable. For example, excessively high concentrations of sodium thiosulfate would be impractical as the slurry would become saturated and any excess sodium thiosulfate would simply settle out effectively lending nothing to the reaction process.

Sodium metabisulfite would typically be added to the pulp slurry in sufficient quantities to bring the pH of the solution to approximately 5.5 to 7.5 with an optimal pH range being approximately 5.5 to 6.0.

It is noted that the starting pH of the pulp slurry in an alkaline circuit (i.e. prior to treatment with the activation reagents and metal release components) is typically approximately from 7.0 to 9.0. However, a variety of factors can affect the starting pH including, but not limited to, the acidity or alkalinity of the water used in the milling process. Adjusting the pH so that it is optimized for use with the present invention could be accomplished by numerous means known in the art.

The quantity of metal release component is typically governed by the metal values that have been put in solution by the activation reagents. In other words, a user would strive to match the amount of metal release component with the amount of metal reacting with the activation reagents. Field tests known in the art can be utilized to assess such amounts. An excess would not impair the operability of the process; but such waste of metal release components may not be desirable for economic reasons. It is also noted that, in certain circumstances, an excess amount of the metal release component may be added so that re-dissolution of the target nonferrous metal does not occur. Any excess, unreacted metal release component could be collected downstream of the LPIP vessel and can be reused in the process.

It is also noted that, the metal release component is often going to be in substantially powder form—such as elemental iron powder. However, it is noted that the metal release component need not be in powder form; but could in fact have numerous configurations. For example, the metal release component could be a rod or other geometric shapes comprising one or more metal release components that are placed in the mixing vessel and which serve to draw the metallic minerals off the metal complexes. In yet other embodiments, the metal release component could be a screen that is placed in the vessel—the screen having a larger surface area and therefore a larger reaction interface.

In the LPIP circuit—whether acidic or an alkaline—under some circumstances, it may be desirable to delay the introduction of the metal release component so that the slurry has sufficient time to create the necessary intermediary complexes. For example, when multiple LPIP tanks are utilized, the addition of the metal release component can take place approximately 20 to 30 minutes after the pulp slurry is contacted with the activation reagents. If only a single tank is utilized in the LPIP circuit, the metal release component could be added to the tank approximately 30-45 minutes after the pulp slurry has been contacted with the activation reagents.

One metal release component that is well suited for use with the present process is finely divided iron of a particle size of approximately −35 mesh. Iron is preferable as it is both efficient and economical. However, as noted previously, other metal release components can be utilized as long as they are below the targeted metal on the electrochemical (galvanic series) scale of metals.

By way of illustration, using cuprite ($Cu_2O$) as an example of a nonferrous metallic oxide mineral to be extracted from an ore, a pulp slurry having approximately 25% solids by weight is provided in an alkaline circuit. Sodium thiosulphate ($Na_2S_2O_3$) is added to the pulp slurry in such quantities to be approximately 3% to 4% of the slurry by weight. A quantity of sodium metabisulfite ($Na_2S_2O_5$) as required to make the solution have a pH of approximately 5.5 to 6.5 is then added. Iron metal is added as a metal release component in quantities equal to concentrations of the metal being targeted (based on head grade assays of the ore being processed) plus approximately 0.5% to 1% excess. The iron, when contacted with the leached copper particle in solution, precipitates the leached copper particle out of solution in the LPIP vessel and forms a finely divided metal copper sponge in the ore pulp slurry. This precipitation reaction is represented by the following:

$CuNa_2S_2O_3\text{-}5H_2O(+NaS_2O_5)+Fe \rightarrow FeNa_2S_2O_3\text{-}5H_2O(+NaS_2O_5)+Cu$ All other associated oxide, carbonate, silicate and halide metallic elements contained in the ore and in the slurry will likewise be put in solution by the lixiviant and will also be precipitated out of solution into the slurry by the same stated leaching reaction followed by the precipitation reaction. In cases where native metals and sulfides are in association with these elements, they are contained in the pulp slurry and recovered with the above elements in the concentrate produced by the flotation operation.

These precipitation reactions and associated native metal and sulfide interfaces are represented, for example, by the following:

Gold (native)

$AuNa_2S_2O_3\text{-}5H_2O(+NaS_2O_5)+Fe \rightarrow FeNa_2S_2O_3\text{-}5H_2O(+NaS_2O_5)+Au$ Silver (sulfide mineral Argentite [$Ag_2S$])

$Ag_2SNa_2S_2O_3\text{-}5H_2O(+NaS_2O_5)+Fe \rightarrow FeNa_2S_2O_3\text{-}5H_2O(+NaS_2O_5)+Ag_2S$ Molybdenum (sulfide mineral Molybdenite [$MoS_2$])

$MoNa_2S_2O_3\text{-}5H_2O(+NaS_2O_5)+Fe \rightarrow FeNa_2S_2O_3\text{-}5H_2O(+NaS_2O_5)+Mo$ Tungsten (oxide mineral Scheelite [$CaWO_4$])

$CaWO_4\ 2S_2O_3\text{-}5H_2O(+NaS_2O_5)+Fe \rightarrow FeNa_2S_2O_3\text{-}5H_2O(+NaS_2O_5)+W$ Chromium (oxide mineral Chromite [$FeCr_2O_4$])

$FeCr_2O_4\ 2S_2O_3\text{-}5H_2O(+NaS_2O_5)+Fe \rightarrow FeNa_2S_2O_3\text{-}5H_2O(+NaS_2O_5)+Cr$ Thus, the ore slurry pulp contains all converted oxide, carbonate, silicate and halide metallic elements liberated by the leaching/precipitation process along with the sulfide minerals and native metals which can then be concentrated by known flotation methods as discussed previously herein.

Acid Circuit

It is noted that the foregoing discussion has been largely focused on application of the present invention in an alkaline LPIP circuit. However, it has also been discovered that, in certain circumstances, an acidic LPIP circuit may be desirable.

In an acidic circuit, the preferred activation reagent is a mineral acid such as sulfuric acid. Other suitable mineral acids include, but are not limited to, sulfuric acid, hydrochloric acid, and nitric acid alone or in combination. As discussed in connection with the alkaline embodiments, the subsequent addition of a metal release component similarly results in the formation of a metal sponge that is amenable to froth flotation.

Though the overview of the process as set forth in the figures applies to both an acid and an alkaline circuit, it is noted that, with respect to the description of the LPIP circuit 400 given above (FIG. 1), the nature of the reaction in the acidic embodiments is more precisely characterized as a selective dissolution rather than a leaching. In particular, the activation reagent dissolves the target minerals—i.e. the oxide, silicate, carbonate and halide nonferrous metals of an ore sample. These metals are then precipitated out of solution as a sponge of metallic particles in the pulp slurry. Again, this entire reaction can occur in a single vessel. It is also noted again that the characterization of the present process as a dissolution is consistent with use of that term in the art. However, the present invention is not intended to be limited to a narrow construction of that term.

For an acid circuit, the particle size would again be most effective between approximately 300 mesh and 20 mesh (mill grade). However, it has been discovered that particle sizes of approximately 150 to 65 mesh are particularly well suited for the LPIP process and those processes downstream. While concentrations of solids in the pulp can effectively be as low as 10% by weight and as high as 60%, approximately 25% solids by weight is particularly well suited for both the LPIP circuit and flotation. Solid concentrations that are even lower will respond well to the LPIP process; however, such operations are not generally economically viable. Higher solid concentrations may be desirable in certain circumstances. However, such concentrations tend to sand up in the tanks, flotation operations and thickeners.

In operation, the activation reagent is added to the pulp slurry in sufficient quantities to bring the pH to approximately 1.5 to 2.5 with a preferred pH of approximately 2.5. The contact time for dissolution of the nonferrous oxide metallic minerals is approximately 20-25 minutes; though the amount of time could be more or less depending on the volume of pulp slurry being processed. The metal release component is added in quantities approximately equal to concentrations of the metal being targeted (based on head grade assays of the ore being processed) plus any desired excess to help ensure complete reaction.

In one embodiment, a sufficient quantity of dilute sulfuric acid is added to a pulp slurry that is of approximately 25% solid consistency to make the slurry have a pH of approximately 2.5. The nonferrous metal oxide forms a complex with the activation reagent in solution as characterized by the following reaction where (x) represents the nonferrous metallic oxide being processed:

$(x)O+H_2SO_4 \rightarrow (x)SO_4+H_2O$

Where (x)O can be $Cu_2O$ or WO.

The addition of the activation reagent and metal release component to the pulp slurry (and the chemical reaction of the processes) typically will raise the pH of the mixture. In particular, the pH of the solvent/precipitant/pulp slurry mixture can rise to approximately 3.5 to 4.5 before leaving the LPIP circuit—which is the upper pH levels for typical flotation feed in an acid circuit. The solvent solution thus becomes an elevated acid solution/slurry which requires less adjustment with pH reagents for optimal flotation feed. It is believed that oxidation-reduction reactions thus caused in the process between the metallic oxide particle and the precipitant account for this change.

By way of illustration, using copper oxide Cuprite ($Cu_2O$) as an example of a nonferrous metallic oxide mineral to be extracted from an ore, sulfuric acid ($H_2SO_4$) is used as a solvent solution and added to the pulp slurry in sufficient quantity to formulate the slurry to have a pH of approximately 1.5 to 2.5 in an acid circuit. A sufficient quantity of iron metal equal to the metallic nonferrous particles contained in the ore plus 5% is added as a metal release component to the pulp slurry simultaneously or after the pulp slurry is contacted by the solvent.

The iron, when contacted with the leached copper particle in solution, will precipitate the leached copper particle out of solution in the LPIP vessel and forms a finely divided metal copper sponge in the ore pulp slurry and with the sulfide and native metal particles becomes amenable to and recovered by froth flotation. This precipitation reaction is represented by the following:

$$CuSO4+Fe \rightarrow FeSO4+Cu$$

All other associated oxide metallic elements contained in the ore and in the slurry will likewise be put in solution by the solvent and will also be precipitated out of solution into the slurry by the same stated dissolving reaction followed by the precipitation/cementation reaction. Examples of these precipitation reactions, according to various embodiments of the present invention, are illustrated in the following:

Gold

Gold in nature is a native metal. However, in nature it is commonly associated with oxides such as magnetite (Fe3O4) among other oxides minerals. As the LPIP process treats the associated oxide minerals, the native metal particles such as gold are liberated into the pulp slurry and can be recovered with the other amenable metallic particles in the flotation operation. This is represented by the following:

$$(Ox)AuSO4+Fe \rightarrow FeSO4+Mx+Au$$

Where Ox represents the associated oxide mineral and Mx represents the metal precipitated by the process.

Silver

Silver is similarly a natural native metal that is commonly associated with oxides such as magnetite (Fe3O4) and other oxides minerals. As the LPIP process treats the associated oxide minerals, the native silver particles are liberated into the pulp slurry and can be recovered with the other amenable metallic particles in the flotation operation. This is represented by the following:

$$(Ox)AgSO4+Fe \rightarrow FeSO4+Mx+Ag$$

Whereby Ox represents the associated oxide mineral and Mx represents the metal precipitated by the process.

It is noted that silver also commonly occurs as a sulfide such as argentite (Ag2S). According to one embodiment of the present invention, the reaction of argentite would be represented by the following:

$$Ag2S\ SO4+Fe \rightarrow FeSO4+Ag2S$$

Molybdenum

Molybdenum occurs in nature as a sulfide such as the mineral molybdenite (MoS2). However, in nature it is commonly associated with oxide ores such as magnetite (Fe3O4) among other oxides minerals. According to one embodiment of the present invention, the reaction of molybdenite is represented by the following:

$$MoS2\ SO4+Fe \rightarrow FeSO4+MoS2$$

Tungsten

Tungsten occurs in nature as an oxide mineral such as the mineral wolframite (FeWO4). According to one embodiment of the present invention, the reaction of wolframite is represented by the following:

$$FeWO4\ SO4+Fe \rightarrow FeSO4+(Fe)+W$$

Zinc

Zinc occurs in nature as an oxide silicate such as the mineral calamine (Zn2(OH)2SiO3). Being that powdered manganese (Mg) is below zinc in the electrochemical (galvanic series) scale of metals it can be utilized as the metal release component (e.g. instead of iron). According to one embodiment of the present invention, the reaction of calamine is represented by the following:

$$Zn2(OH)2SiO3\ SO4+Mg \rightarrow MgSO4\ SiO3(OH)2+Zn$$

Nickel

Nickel occurs in nature as the mineral millerite (NiS) that associates with oxide metallic minerals. According to one embodiment of the present invention, the reaction of millerite is represented by the following:

$$NiS\ SO4+Fe \rightarrow FeSO4+Ni$$

Tin

Tin occurs in nature as the mineral cassiterite (SnO2). Being that powdered aluminum (Al) and zinc (Zn) are below tin in the electrochemical (galvanic series) scale of metals they can be utilized as the metal release component. According to one embodiment of the present invention, the reaction of cassiterite is represented by the following:

$$SnO2\ SO4+(Al,Zn) \rightarrow (Al,Zn)SO4+Sn$$

Vanadium and Uranium

Vanadium occurs in nature as a variety of oxides. It occurs as patronite (VS4) or, in combination with uranium as carnotite ($K_2(UO_2)_2(VO_4)_2$). Being that powdered magnesium (Mg) is below vanadium in the electrochemical (galvanic series) scale of metals it can be utilized as the metal release component. According to one embodiment of the present invention, the reaction of carnotite is represented by the following:

$$K_2(UO_2)_2(VO_4)_2)SO_4+Mg \rightarrow Mg\ K_2(O_2)_2(O_4))SO_4+V+U$$

Thus, the LPIP process liberates the uranium and vanadium of the carnotite and makes their subsequent recovery through flotation possible. In this embodiment, the patronite would be unaffected by the LPIP process; but would simply continue downstream and be recovered as a sulfide through standard flotation techniques.

Manganese

Manganese occurs in nature as an oxide such as the mineral psilomelane (4MnO2). Being that powdered aluminum (Al) is below manganese in the electrochemical (galvanic series) scale of metals, it can be utilized as the metal release component in one embodiment of the present invention. According to one embodiment of the present invention, the reaction of psilomelane is represented by the following:

$$4MnO2SO4+Al \rightarrow AlSO4+Mn$$

Chromium

Chromium occurs in nature as an oxide such as the mineral chromite (FeCr2O4). Being that powdered aluminum (Al) is below chromium in the electrochemical (galvanic series) scale of metals, it can be utilized as the metal release component. According to one embodiment of the present invention, the reaction of chromite is represented by the following:

$$FeCr_2O_4SO_4+Al \rightarrow AlSO_4+Fe+Cr$$

Applying to the LPIP process in another scenario, sulfuric acid (as an activation reagent) and elemental iron (as a metal release component) are added to a pulp slurry containing the metallic mineral argentite ($Ag_2S$). Argenite, being a sulfide, does not undergo the dissolution and precipitate process but is cleaned of contaminant oxides and reports with the slurry to the flotation circuit where it is recovered.

Applying to the LPIP process in another scenario, sulfuric acid (as an activation reagent) and elemental iron (as a metal release component) are added to a pulp slurry containing the Native Metals of Gold [Au], Silver [Ag], Copper [Cu], Platinum [Pt], or Electrum [Au/Ag combined]. Being native metal particles, these particles do not undergo the dissolution and precipitate process but are cleansed of contaminant oxides and report with the slurry to the flotation circuit where they are recovered.

Not intending to limit the present invention to any particular type of ore, it has been discovered that the present invention in its various embodiments is suitable for a variety of copper-rich ores and oxides including but not limited to: Tenorite; Malachite; Brochanite; Chrysocolla; Azurite; Cuprite; Antierite; Georgeite; Ludjibaite; Andyrobertsite; Lammerite Carbonatecyanotrichite; Euchroite; Atacamite; Connellite; Botallackite; Claringbullite; Bellidoite/Berzelianite; Derriksite; Rosasite; Paramelaconite; Atacamite; Dioptase; Melanothallite; Lindgrenite; Apachite; Szenicsite; Bayldonite; Plancheite; Liroconite; Marthozite; Callaghanite; Cornwallite; Atacamite; Carbonatecyanotrichite; Santarosaitee; Goudeyite; Clinoclase; Arhbarite; Haydeeite; Turquoise; Kinoite; Calumetite; Serpierite; Volborthite; Strashimirite; Aurichalcite; Conichalcite; and Juangodoyite; Chalcocite; Covellite, Bellidoite/Berzelianite; Orthoserpierite; Roxbyite; Bornite; Digenite; Derriksite; Redgillite; Ktenasite; Spangolite; Boothite; Cyanotrichite; Leightonite; Aubertite; Chalcanthite; Brochantite; Chalcopyrite; Woodwardite; Kröhnkite; Devilline; Caledonite; Camerolaite; Cyanotrichite; Native Cu; and Mohawkite.

It has been discovered that the present invention in its various embodiments is also suitable for a variety of molybdenum-rich ores and oxides including but not limited to: Lindgrenite and Szenicsite.

It has been discovered that the present invention in its various embodiments is also suitable for a variety of nickel-rich ores and oxides including but not limited to: Oregonite and Annabergite.

It has been discovered that the present invention in its various embodiments is also suitable for a variety of uranium-rich ores and oxides including but not limited to: Derriksite, Marthozite and Metatyuyamunite.

It has been discovered that the present invention in its various embodiments is also suitable for a variety of zinc-rich ores and oxides including but not limited to: Orthoserpierite and Serpierite.

It has been discovered that the present invention in its various embodiments is also suitable for a variety of tin-rich ores and oxides.

Examples

1. Alkaline Circuit a) A volume of semi-oxide ore was crushed and pulverized to between approximately 65 mesh and 150 mesh using standard techniques of crushing and grinding. Samples were taken from the ground lot and assayed for total Cu, Oxide Cu, Fe Au, Ag, Mo and W. The results of the assay were determined to be:

Total Cu 3.810-3.91%
Cu Oxide 3.480%
Cu Sulfide 0.330%
Fe (magnetite?) 8.400%
Au 0.013 OPT
Ag 1.940 OPT
Mo 0.034%
W 0.0096% b) Sodium Thiosulfate ($Na_2S_2O_3$) at an approximate 2%-4% volume of solution with Sodium Metabisulfite ($NaS_2O_5$) modifier, at an approximate 0.01-0.05% volume of solution were added to water to produce a lixiviant/ligand solution having a pH of approximately 5.5-6.0 as determined by litmus paper color indication.

c) Three dry pounds of the pulverized semi-oxide ore was added to nine pounds of this lixiviant solution to produce a slurry of 25% by weight as follows:

$$A+B=C$$

$$A \div C \times 100=D$$

Where: A=weight of solids
B=weight of 0.49% acid solution
C=total mass weight of slurry
D=percent solids of slurry As: (3)+(9)=(12)

(3)÷(12)=0.25×100=25% solids.

d) The slurry was agitated in vessel for approximately 25 minutes by a mixer.

e) During that time four ounces of a solid precipitant (iron metal powder) were added to the wet pulp-in-leach slurry as follows:

3 lbs ore pulp containing approximately 3.84% total Cu=
48 ounces of ore pulp @ 3.84% Cu=1.84 ounces of total Cu
4 ounces of powdered Fe precipitant>equilibrium (Note: extra precipitant was used to avoid re-solution of metallic minerals).

f) The slurry now consisting of the solvent, precipitant and pulp in the vessel being agitated for that time to leach the target metallic minerals and drop metallic particles from solution into pulp in the LPIP vessel.

g) The pulp slurry was sent to a conditioner vessel and treated with standard mining reagents (collector, retardant and frothing chemical reagents) prior to flotation. The collector reagent was approximately 1 teaspoon Flomin C 4920 and 1 teaspoon C 4940. A retardant reagent was added at approximately two teaspoons of Sodium Sulfite and Sodium Silicate (liquid glass) at approximately 0.5 lbs/ton in a 10% solution as a reagent to depress iron, arsenic and fluorine contained in the ore. The frothing reagent was approximately 2 teaspoons of Flomin F 161. Lime was added to bring the pH of the slurry to approx 8.0 as determined by litmus paper color indication. The solution was mixed for approximately 15 additional minutes after the addition of the mining reagents.

h) The precipitant-in-pulp solution from the LPIP cycle along with the reagents from the conditioning cycle was then added to the flotation cell. Air was bubbled through the solution while it was being agitated producing a froth.

i) The froth overflow from the flotation operation was collected as it was produced until visible signs of substantial frothing had ceased. The solid pulp remaining in the flotation cell after collecting the froth reported as tails.

j) The concentrate from the flotation collected was thickened and filtered. The clarified filtered solution was returned to the flotation cell. The thickened concentrate collected was then dried, collected, weighed and tested.

k) The rough concentrate yielded the following recoveries:
Total Cu 29.5%
Total Fe 12.7%
Total Au 0.48 OPT
Total Ag 12.25 OPT
Total Mo 0.24%
Total W 0.010%

It is noted that the concentrations above resulted from what is known as a "rough concentrate." In actual flotation operations it is standard practice to run further flotation circuits after the rougher circuit that may include regrind circuits, scavenger flotation circuits and cleaner flotation circuits in sequence to optimize mineral recovery as a means to further concentrate the metallic minerals and produce a higher grade of final concentrates suitable for sale to a smelter or further refinement in a concentrate SXEW circuit.

2. Acid Circuit

Method 1 a) A volume of semi-oxide ore was crushed and pulverized to 65 mesh using known techniques. Two samples were taken from the total ground lot and assayed for total Cu, Oxide Cu, Fe Au, Ag, Mo and W. The results of the assay were determined to be:
Total Cu 3.810-3.91%
Cu Oxide 3.480%
Cu Sulfide 0.330%
Fe (magnetite?) 8.400%
Au 0.013 OPT
Ag 1.940 OPT
Mo 0.034%
W 0.0096% b) Sulfuric Acid 50% was added to water to produce a solvent of 0.49-0.50% acid solution having a pH level of approximately 1.5 to 2.0.

c) Three dry pounds of the pulverized semi-oxide ore was added to nine pounds of the solvent to produce a slurry of 25% by weight as follows:

$$A+B=C$$

$$A\div C\times 100=D$$

Where: A=weight of solids
B=weight of 0.49% acid solution
C=total mass weight of slurry
D=percent solids of slurry As: (3)+(9)=(12)

(3)÷(12)=0.25×100=25% solids.

d) The slurry was agitated in vessel for approximately 25 minutes by a mixer.

e) After the dissolution cycle four ounces of a solid precipitant (iron metal powder) were added to the wet pulp-in-leach slurry as follows:

3 lbs ore pulp containing approximately 3.84% total Cu=
48 ounces of ore pulp @ 3.84% Cu=1.84 ounces of total Cu
4 ounces of powdered Fe precipitant>equilibrium (Note: extra precipitant was used to avoid re-solution of metallic minerals).

f) The slurry now consisting of the solvent, precipitant and pulp in the LPIP vessel was agitated for approximately 20 minutes to drop metallic minerals from solution into pulp in the LPIP vessel.

g) The pulp slurry was sent to a conditioner vessel and treated with standard mining reagents (collector, retardant and frothing chemical reagents) prior to flotation. The collector reagent was approximately 1 teaspoon Flomin C 4920 and 1 teaspoon C 4940. A retardant reagent was added at approximately two teaspoons of Sodium Sulfite and Sodium Silicate (liquid glass) at approximately 0.5 lbs/ton in a 10% solution as a reagent to depress iron, arsenic and fluorine contained in the ore. The frothing reagent was approximately 2 teaspoons of Flomin F 161. The solution was mixed for approximately 15 additional minutes after the addition of the mining reagents. (It should be noted that after the LPIP vessel involves standard flotation operations that may be utilized by one skilled in the art.)

h) The precipitant-in-pulp solution with reagents was then added to the flotation cell. Air was bubbled through the solution while it was being agitated producing a froth.

i) The froth overflow from the flotation operation was collected as it was produced until visible signs of substantial frothing had ceased. The solid pulp remaining in the flotation cell after collecting the froth was sent to tails.

j) The concentrate from the flotation collected was thickened and filtered. The clarified filtered solution was returned to the flotation cell. The thickened concentrate collected was then dried, collected, weighed and tested.

k) The rough concentrate yielded the following recoveries:
Total Cu 28.5%
Total Fe 11.5%
Total Au 0.49 OPT
Total Ag 11.90 OPT
Total Mo 0.21%
Total W 0.012%

It is noted that the concentrations above resulted from what is known as a "rough concentrate." In actual flotation operations it is standard practice to run further flotation circuits after the rougher circuit that may include regrind circuits, scavenger flotation circuits and cleaner flotation circuits in sequence to optimize mineral recovery as a means to further concentrate the metallic minerals and produce a higher grade of final concentrates suitable for sale to a smelter or further refinement in a concentrate SXEW circuit.

3. Acid Circuit

Method 2 a) Using the same semi-oxide ore as discussed in Example 1, Sulfuric Acid 50% was added to water to produce a solvent of 0.49-0.50% acid solution having a pH level of approximately 1.5 to 2.0.

b) Three dry pounds of the pulverized semi-oxide ore and four ounces of iron metal powder (precipitant) were added to nine pounds of the solvent to produce a slurry of approximately 26.5% by weight as follows:

$$A+B=C$$

$$A\div C\times 100=D$$

Where: A=weight of solids (including precipitant)
B=weight of 0.49% acid solution
C=total mass weight of slurry
D=percent solids of slurry As: (3.25)+(9)=(12.25)

(3.25)÷(12.25)=0.25×100=26.5% solids.

(Note: extra precipitant was again used to avoid re-solution of metallic minerals).

c) The slurry was agitated in the LPIP vessel for approximately 25 minutes by a mixer until equilibrated.

d) The pulp slurry was sent to a conditioner vessel and treated with standard mining reagents (collector, retardant and frothing chemical reagents) prior to flotation. The collector reagent was approximately 1 teaspoon Flomin C 4920 and 1 teaspoon C 4940. A retardant reagent was added at approximately two teaspoons of Sodium Sulfite and Sodium Silicate (liquid glass) at approximately 0.5 lbs/ton in a 10% solution as a reagent to depress iron, arsenic and fluorine contained in the ore. The frothing reagent was approximately 2 teaspoons of Flomin F 161. The solution was mixed for approximately 15 additional minutes after the addition of the mining reagents.

e) The precipitant-in-pulp solution with reagents was then added to the flotation cell. Air was bubbled through the solution while it was being agitated producing a froth.

f) The froth overflow from the flotation operation was collected as it was produced until visible signs of substantial frothing had ceased. The solid pulp remaining in the flotation cell after collecting the froth was sent to tails.

g) The concentrate from the flotation collected was thickened and filtered. The clarified filtered solution was returned to the flotation cell. The thickened concentrate collected was then dried, collected, weighed and tested.

h) The rough concentrate yielded the following recoveries:

Total Cu 28.9%
Total Fe 11.3%
Total Au 0.45 OPT
Total Ag 11.37 OPT
Total Mo 0.20%
Total W 0.014%

The invention claimed is:

1. A method of extracting a targeted metallic mineral from an ore comprising the steps of:

a) Providing an ore slurry containing the metallic mineral in oxide, carbonate, silicate or halide form;

b) Activating the ore slurry by adding sodium thiosulfate and sodium metabisulfite, whereby the targeted metallic mineral forms an intermediary metal complex with the sodium thiosulfate and sodium metabisulfite;

c) Introducing one or more metal release components into the ore slurry; whereby the targeted metallic mineral is released from the intermediary metal complex to form a metal sponge;

d) Subjecting the metal sponge to a flotation process, whereby the targeted metallic mineral is drawn out of the ore slurry and thereby extracted from the ore.

2. The method of claim 1, wherein the metal release component is one or more precipitants.

3. The method of claim 2, wherein the metal release component is one or more precipitants selected from the group consisting of iron, copper, zinc, carbon, aluminum, sodium sulfate, calcium sulfate and sulfur dioxide.

4. The method of claim 1, wherein the metallic mineral is one or more minerals selected from the group consisting of copper, nickel, vanadium, uranium, molybdenum, tungsten, tin, zinc, aluminum, mercury, magnesium, manganese, chromium, gold, silver, platinum, palladium and rhodium.

5. The method of claim 1, wherein the sodium thiosulfate and sodium metabisulfite are added to the ore slurry during milling.

6. The method of claim 1, wherein the ore slurry is approximately 25% solids by weight.

7. The method of claim 1, wherein the sodium thiosulfate constitutes approximately 2%-6% by weight of the slurry.

8. The method of claim 7, wherein the sodium metabisulfite is added in sufficient quantities as to bring the pH of the slurry to approximately 5.5 to 6.0.

9. The method of claim 1, wherein the ore slurry comprises particle sizes of approximately 150-65 mill grade mesh.

10. The method of claim 1, wherein the sodium thiosulfate, sodium metabisulfite and metal release components are added in a single mixing vessel.

11. The method of claim 1, wherein the sodium thiosulfate, sodium metabisulfite and metal release components are added in multiple mixing vessels.

12. The method of claim 1, wherein the sodium thiosulfate and sodium metabisulfite are allowed to mix for approximately 20-30 minutes prior to adding the metal release component.

13. The method of claim 1, wherein the sodium thiosulfate and sodium metabisulfite are allowed to mix for approximately 30-45 minutes prior to adding the metal release component.

14. The method of claim 1, wherein the sodium thiosulfate, sodium metabisulfite and metal release component are allowed to mix for approximately 23 minutes.

15. The method of claim 1, wherein the metal release component is in substantially powder form.

16. The method of claim 15, wherein the metal release component is iron powder.

17. The method of claim 1, wherein the metal release component is substantially rod-shaped.

18. The method of claim 17, wherein the metal release component is iron.

19. The method of claim 1, wherein the metal release component is geometrically shaped.

20. The method of claim 1, wherein the metal release component is a screen.

* * * * *